US005165258A

United States Patent [19]

Kogen

[11] Patent Number: 5,165,258

[45] Date of Patent: Nov. 24, 1992

[54] CUSHION FOR CLIP-ON EARRINGS

[75] Inventor: Robert A. Kogen, Villanova, Pa.

[73] Assignee: L. Lawrence Products, Inc., Huntingdon Valley, Pa.

[21] Appl. No.: 879,067

[22] Filed: May 1, 1992

Related U.S. Application Data

[63] Continuation of Ser. No. 738,993, Aug. 1, 1991, abandoned.

[51] Int. Cl.[5] ..... A44C 7/00

[52] U.S. Cl. ..... 63/12

[58] Field of Search ..... 63/2, 12, 13, 14.1, 63/14.2, 14.3, 14.4, 14.5, 14.8

[56] References Cited

U.S. PATENT DOCUMENTS

| | | | |
|---|---|---|---|
| 148,996 | 3/1874 | Stevens | 63/12 |
| 241,462 | 5/1881 | Washburn | 63/13 |
| 248,240 | 10/1881 | Washburn | 63/12 |
| 360,423 | 4/1887 | Edge | 63/14.1 |
| 421,433 | 2/1890 | Rees | 63/13 |
| 782,313 | 2/1905 | Zirinsky | 63/12 |
| 2,715,821 | 8/1955 | Herbert | 63/14.3 |
| 2,775,014 | 12/1956 | Gollobin | 63/14.3 X |
| 3,122,007 | 2/1964 | Horland | 63/12 |
| 3,910,065 | 10/1975 | Holt | 63/12 |
| 3,945,089 | 3/1976 | Gagnon | 63/12 X |
| 4,003,216 | 1/1977 | Cecore et al. | 63/12 |
| 4,688,400 | 8/1987 | Chioffe | 63/12 |
| 4,771,613 | 9/1988 | Grier et al. | 63/12 |
| 4,907,424 | 3/1990 | Reinstein et al. | 63/12 |
| 4,979,379 | 12/1990 | Quaranto | 63/14.4 |

FOREIGN PATENT DOCUMENTS

| | | | |
|---|---|---|---|
| 42654 | 2/1888 | Fed. Rep. of Germany | 63/12 |
| 65910 | 3/1914 | Fed. Rep. of Germany | 63/12 |
| 2538228 | 6/1984 | France | 63/12 |
| 10669 | 4/1897 | United Kingdom | 63/12 |
| 2149646 | 6/1985 | United Kingdom | 63/12 |

*Primary Examiner*—Renee S. Luebke
*Assistant Examiner*—Jerry Redman
*Attorney, Agent, or Firm*—Caesar, Rivise, Bernstein, Cohen & Pokotilow, Ltd.

[57] ABSTRACT

A cushion for securement to a clip of a clip-on earring having a decorative portion including a rear surface a clip secured thereto. The clip comprises a loop which is arranged to engage the rear of a wearer's earlobe while the rear surface of said decorative portion of said earring engages the front of said earlobe to sandwich the earlobe therebetween. The cushion comprises a disk of resilient material, e.g., silicone rubber, having a top wall, a bottom wall, a circular outer side wall having an annular groove extending about its periphery, and a central opening extending through said disk. The cushion is inserted within the loop of the clip so that the loop is disposed within the cushion's annular groove. The top wall of the cushion is convex and the central opening is small to provide a relatively large area to engage the rear surface of the earlobe and thereby spread out the force applied to the earlobe by the clip.

6 Claims, 1 Drawing Sheet

FIG. 1
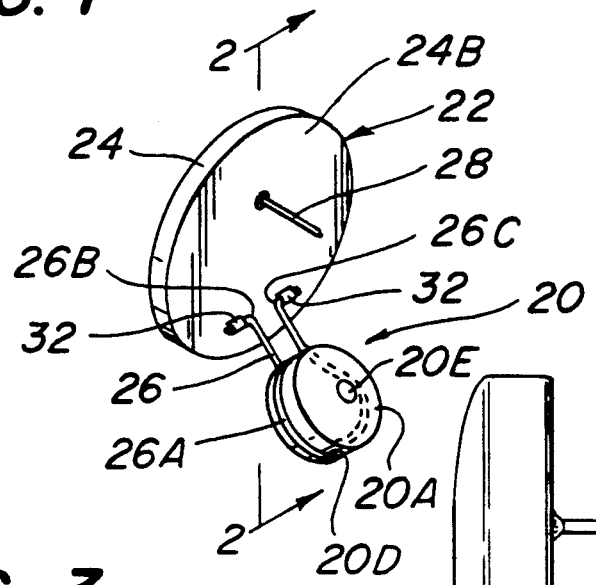
FIG. 2
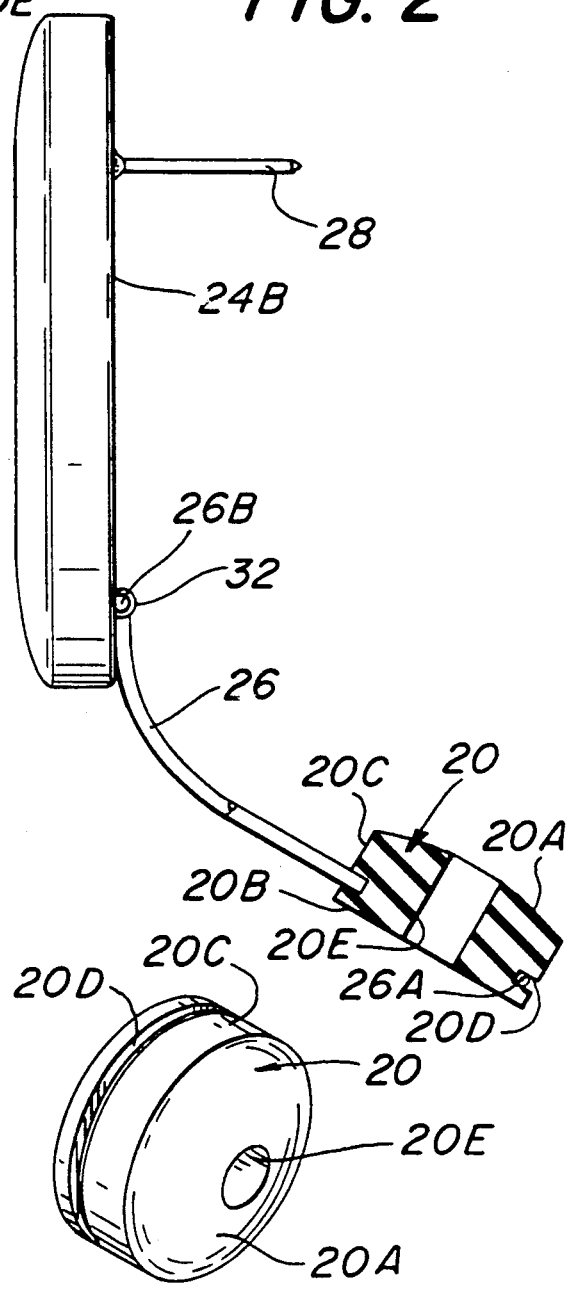
FIG. 3
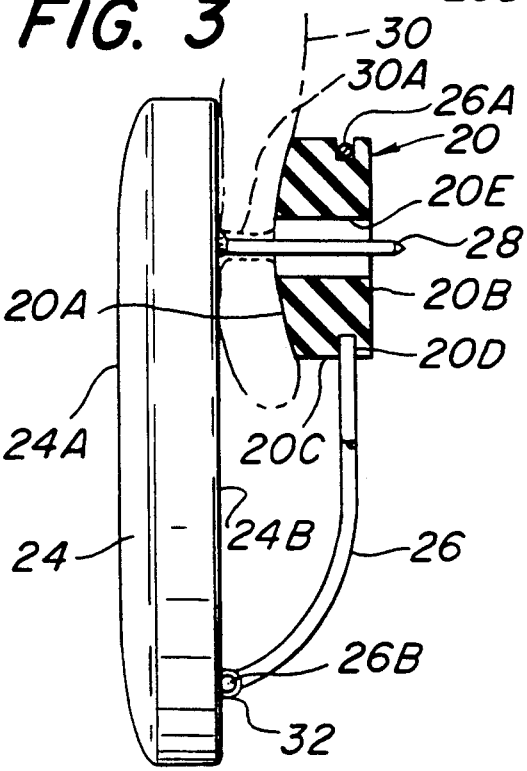
FIG. 5
PRIOR ART
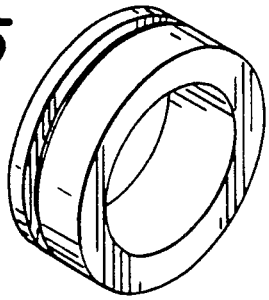
FIG. 4

CUSHION FOR CLIP-ON EARRINGS

This application is a continuation of application Ser. No. 07/738,993, filed Aug. 1, 1991 now abandoned.

BACKGROUND OF THE INVENTION

This invention relates generally to pads and more particularly to cushions for securement to clip-on type earrings.

Clip-on earrings typically comprise a decorative member arranged to be disposed on the front surface of the ear lobe and a clip portion mounted on the back of the decorative member and arranged to engage the back surface of the ear lobe so that the ear lobe is sandwiched therebetween. One common type of clip-on earring commercially available is known as a "French/Omega clip earring". That earring utilizes a decorative portion having a pin projecting normally from the rear surface thereof to extend through a hole in the wearer's ear lobe. A clip in the form of a planar loop of wire is also mounted on the rear of surface of the decorative portion and is biased to pivot toward the decorative portion to sandwich the ear lobe therebetween while the pin extends through the opening in the loop. Due to the nature of the loop, such earrings are somewhat uncomfortable. In addition the earrings are somewhat unstable, i.e., they tend to migrate or pivot about.

In order to reduce the pressure which the loop of the French/Omega clip earring concentrates on the ear lobe when the earring is in place and to reduce the earring instability cushions are commercially available for mounting on the clip loop. One such cushion is sold under the trademark PILLOWS and basically comprises a hollow disk-like element formed of a resilient plastic material. The cushion includes an opposed pair of planar walls and a circular outer side wall having an annular groove extending about its periphery. The cushion is arranged to be inserted within the clip loop so that the loop is disposed within the annular groove, whereupon one of the planar side walls engages the rear surface of the ear lobe to spread out the force applied to the ear lobe. While such cushions are generally suitable for their intended purposes, they still leave something to be desired from the standpoint of wearer comfort.

OBJECTS OF THE INVENTION

Accordingly, it is a general object of this invention to provide a cushion for a clip on earring which overcomes the disadvantages of the prior art.

It is a further object of this invention to provide a cushion for a clip-on earring which is provides an increased ear lobe engaging surface than prior art cushions to enhance the comfort of the person wearing the earring.

SUMMARY OF THE INVENTION

These and other objects of this invention are achieved by providing a cushion for a clip-on earring. The earring has a decorative portion including a rear surface and a clip secured thereto. The clip is in the form of a loop which is arranged to be moved toward the rear surface of the decorative portion of the earring to engage the rear of a wearer's earlobe while the rear surface of the decorative portion of the earring engages the front of said earlobe to sandwich the earlobe therebetween.

The cushion comprises a disk-like element having a top wall, a bottom wall, a circular outer side wall having an annular groove extending about its periphery, and an opening extending through the disk-like element between the top wall and the bottom wall. The cushion is arranged to be inserted within the loop of the clip so that the loop of the clip is disposed within the annular groove.

In accordance with the teachings of this invention the top wall of the cushion is convex and the opening in the cushion is of small inside diameter so that the surface of the top wall is relatively large, whereupon when the convex top wall surface engages the rear surface of the ear lobe as the earring is worn it spreads out the force applied to the ear lobe by the clip.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a isometric view of a French/Omega clip earring with its clip shown in its closed state mounting a cushion constructed in accordance with this invention;

FIG. 2 is an enlarged sectional view taken along line 2—2 of FIG. 1;

FIG. 3 is an enlarged sectional view like that of FIG. 2 but showing the clip in its opened state;

FIG. 4 is an enlarged perspective view of the cushion shown in FIGS. 1-3; and FIG. 5 is a view similar to that of FIG. 4 but showing the prior art cushion referred to heretofore.

DETAILED DESCRIPTION OF THE PREFERRED EMBODIMENTS

Referring now to various figures of the drawing where like reference numerals refer to like parts there is shown at 20 in FIG. 1 a cushion constructed in accordance with this invention for use with a conventional French/Omega clip earring 22 or other similar type clip-on earring.

The earring 22 basically comprises a decorative member or element 24 and a clip 26. The decorative element may take any shape, depending upon the desired aesthetics, but typically comprises a disk like member having a front surface 24A which is decorative, and a planar rear surface 24B. The clip 26 is mounted on the rear surface 24B of the member 24. A pin 28 projects normally from the rear surface 24A of the member 24 above the location of the clip 26.

The rear surface 24 of the earring is arranged to engage the front of the wearer's earlobe (shown by the phantom line 30 in FIG. 3) while the clip 26 engages the rear of that earlobe when the earring is in place.

The clip basically comprises a loop 26A of wire terminating in a pair of legs 26B and 26C. The ends of the legs are journaled within a pair of sockets 32 located on the rear surface 24B of the member 24. Means (not shown) are provided to bias the loop 26A towards the rear surface 24A. Accordingly, when the earring 22 is in place the earlobe 30 is tightly sandwiched between the loop 26 and the rear surface 24B of the earring element 24, with the pin 28 extending through a hole (shown by the phantom line 30A in FIG. 3) in the wearer's earlobe 30.

The cushion 20 of this invention is arranged to be mounted on the clip 24 of the earring to cushion the wearer's earlobe from the clamping force created by the clip. As can be seen clearly in FIGS. 2-4 the cushion 20 is in the form of a disk-like element formed of a resilient material, e.g., silicone rubber. The element 20 has a top wall 20A, a bottom wall 20B, a circular side wall 20C having an annular groove 20D extending about its periphery, and an opening or passageway 20E. The opening or passageway 20E extends through the disk-like element between the top wall 20A and the bottom wall 20B. The passageway 20E enables the pin 28 of the earring to extend therethrough when the earring is in place on the earlobe.

The cushion 20 is mounted on the clip by inserting it within the clip's loop 26A so that the loop is disposed within the annular groove 20D of the cushion. The outside diameter of the annular recess 20D is approximately the same size as the inside diameter of the loop 26C. Thus, since the cushion is formed of a resilient material it may be readily inserted within the loop. The outside diameter of the sidewall 20C of the cushion may be of any suitable size consistent with the construction of the earring 22.

In one commercial embodiment of the invention shown herein the outside diameter of the cushion is approximately 11 mm. In that embodiment the inside diameter of the central passageway 20E is small, e.g., 3 mm, so that the surface area of the top wall 20A which will engage the earlobe is kept relatively large. Hence the clamping force applied to the earlobe is spread out or dissipated by the relatively large surface area of the cushion's top wall 20A. This feature should be contrasted to the prior art cushion shown in FIG. 5 wherein a comparably sized cushion has a central opening of approximately 6 mm.

In order to further increase the surface area of the cushion's top wall, and hence increase its force dissipation properties, the surface of the top wall is not planar (as is the prior art). Rather the surface of the top wall 20A is convex. Not only does the convex top surface provide a greater area to dissipate the clamping force produced by the earring's clip it also provides a gentle curve to the periphery of the cushion where it engages the earlobe. This further enhances wearing comfort.

As should be appreciated from the foregoing the cushion of the subject invention is simple in construction, can be manufactured at approximately the same low costs as the prior art, and provides enhanced comfort to the wearer.

Without further elaboration the foregoing will so fully illustrate my invention that others may, by applying current or future knowledge, adopt the same for use under various conditions of service.

I claim:

1. In combination a cushion and an earring having a decorative portion including a rear surface having a generally cylindrical pin and a clip secured thereto, said pin projecting generally perpendicularly to said rear surface, said clip being in the form of a loop of material terminating in a pair of legs each of which is pivotally secured to said rear surface wherein said loop is adapted to engage the rear of a wearer's earlobe while the rear surface of said decorative portion of said earring engages the front of said earlobe, said cushion comprising a disk-like element comprised of a pliable, elastomeric material and having a top wall, a bottom wall, a circular outer side wall having an annular groove extending about its periphery, and an opening extending through said disk-like element between said top wall and said bottom wall, said cushion being arranged to be inserted within said loop of said clip so that said loop of said clip is disposed within said annular groove, said loop of said clip being arranged to be pivoted toward said rear surface of said decorative portion of said earring to cause said pin to readily enter said opening, said cushion being characterized in that said top wall is convex having a central apex and said opening is of a constant inside diameter of approximately 3 mm centered at said apex, said constant inside diameter being greater than the diameter of said pin prior to insertion of said pin, said opening having a peripheral edge at its intersection with said top wall, said cushion having an outside diameter of approximately 11 mm so that the surface of said convex top wall has a relatively large area and a convex curve from the peripheral edge of said opening to the circular outer side wall, whereupon substantially all of said convex top wall surface snugly engages the rear surface of the ear lobe to spread out the force applied to the ear lobe by the clip.

2. The combination of claim 1 wherein said cushion is formed of a resilient material.

3. The combination of claim 2 wherein said material comprises silicone rubber.

4. The combination of claim 2 wherein said annular groove is located closer to said bottom wall than to said top wall.

5. The combination of claim 1 wherein said annular groove is located closer to said bottom wall than to said top wall.

6. The combination of claim 3 wherein said annular groove is located closer to said bottom wall than to said top wall.

* * * * *